US007347743B2

(12) United States Patent
Daugherty et al.

(10) Patent No.: US 7,347,743 B2
(45) Date of Patent: Mar. 25, 2008

(54) STAGABLE ELECTRICAL CONNECTOR AND METHOD OF ASSEMBLY

(75) Inventors: James D. Daugherty, Brookfield, OH (US); William G Strang, Warren, OH (US); Michael Bashkin, Solon, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/406,933

(22) Filed: Apr. 19, 2006

(65) Prior Publication Data

US 2007/0249238 A1 Oct. 25, 2007

(51) Int. Cl.
*H01R 13/514* (2006.01)

(52) U.S. Cl. ..... 439/752; 439/595; 439/871

(58) Field of Classification Search ..... 439/752, 439/595, 871

See application file for complete search history.

(56) References Cited

U.S. PATENT DOCUMENTS 5,522,740 A * 6/1996 Plocek et al. ..... 439/752
5,722,857 A * 3/1998 Saito et al. ..... 439/595
5,980,318 A 11/1999 Morello et al.
6,089,927 A * 7/2000 Seko et al. ..... 439/752
6,115,915 A * 9/2000 Kawase ..... 29/881

* cited by examiner

*Primary Examiner*—Renee Luebke
*Assistant Examiner*—Vanessa Girardi
(74) *Attorney, Agent, or Firm*—David P. Wood

(57) ABSTRACT

A stagable electrical connector and method of assembly has a housing and a shuttle that moves with respect to the housing from a staged position to an assembled position. An electrically conductive terminal snap fits to the shuttle when in the staged position and generally does not move with respect to the shuttle as the shuttle is then moved from the staged position to the assembled position that further secures the terminal to the shuttle. Preferably, a one-way coupler is carried between the shuttle and the housing to strongly resist withdrawal of the shuttle from the housing as the terminal is snap fitted to the shuttle. During snap fitting of the terminal, a flex beam of the shuttle is free to move giving way to the terminal and resiliently flexing back when the terminal is fitted to the shuttle. Rearward movement of the shuttle with respect to the housing places a distal catch end of the flex beam snugly between a reinforcement structure of the housing and the terminal preventing flexing of the flex beam and further securing the terminal to the shuttle.

18 Claims, 4 Drawing Sheets

STAGABLE ELECTRICAL CONNECTOR AND METHOD OF ASSEMBLY

FIELD OF THE INVENTION

The present invention relates to an electrical connector and more particularly to a stagable electrical connector having a terminal locking inner shuttle and method of assembly.

BACKGROUND OF THE INVENTION

Electrical connectors such as that disclosed in U.S. Pat. No. 5,980,318, issued Nov. 9, 1999, and incorporated herein by reference in its entirety, are known to have female terminals that snap lock into a connector housing. During assembly of conventional connectors, the terminal is inserted axially along a connector mating axis whereupon a bottom portion of the terminal rides upward upon a ramped tab projecting radially inward and upward in a terminal cavity defined by the housing. As the bottom portion of the terminal rides upward, a top portion of the terminal contacts and resiliently bends a flex beam of the housing radially outward and upward. The terminal snap locks to the housing when a window in the lower portion of the terminal aligns axially to the tab causing the resilient force of the flex beam to push down upon the terminal thus snap fitting the tab into the window.

Although these electrical connectors have generally worked well for smaller connectors used in twelve to fourteen volt automotive electrical systems, high voltage systems having direct current ratings of about 150 amps to 200 amps require much larger connectors that require connector retention values of at least 150 Newtons. Unfortunately, known electrical connector housings and inner locking bodies for high voltage systems are insufficient for reliable terminal retention. Specifically, the flexibility of the flex beam is not restricted even after the connector is fully assembled, thus known terminals, and especially terminals of larger size and larger cable size, can rock within the housing cavity. This terminal rocking and flex beam deflection may ultimately cause failure of terminal retention to the housing.

SUMMARY OF THE INVENTION

A stagable electrical connector has a housing and a shuttle that moves with respect to the housing from a staged position to an assembled position. An electrically conductive terminal snap fits to the shuttle when in the staged position and generally does not move with respect to the shuttle as the shuttle is then moved from the staged position to the assembled position that further secures the terminal to the shuttle. Preferably, a one-way coupler is carried between the shuttle and the housing to strongly resist withdrawal of the shuttle from the housing as the terminal is snap fitted to the shuttle. During snap fitting of the terminal, a flex beam of the shuttle is free to resiliently move giving way to the terminal and flexing back when the terminal is fitted to the shuttle. Rearward movement of the shuttle with respect to the housing places a distal catch end of the flex beam snugly between a reinforcement structure of the housing and the terminal preventing flexing of the flex beam and further securing the terminal to the shuttle.

Preferably, a staging feature and an assembly retention feature are carried between at least one slightly flexible partitions of the shuttle and the housing. The staging feature yieldably restricts further movement of the shuttle into the housing when in the staged position, and the assembly retention feature prevents partial withdrawal of the shuttle from the housing when in the assembled position. When the shuttle is in the staged position, the terminal preferably snap fits to the shuttle via a projection that projects inwardly from a web segment of the shuttle, preferably made rigid by the partition, and into a window in the terminal.

Objects, features, and advantages of this invention include an electrical connector capable of securing an electrically conductive terminal, preferably of a high voltage circuit, to a connector housing of sufficient strength to resist rocking of the terminal with respect to the housing when plugging and un-plugging the connector. Other advantages include a connector that is easily assembled, relatively simple and robust in design, is compact, lightweight, economical to manufacture.

BRIEF DESCRIPTION OF THE DRAWINGS

These and other objects, features and advantages of the invention will become apparent from the following detailed description of the preferred embodiment and best mode, appended claims, and accompanying drawings in which:

DETAILED DESCRIPTION OF PREFERRED EMBODIMENTS

Figure 1:
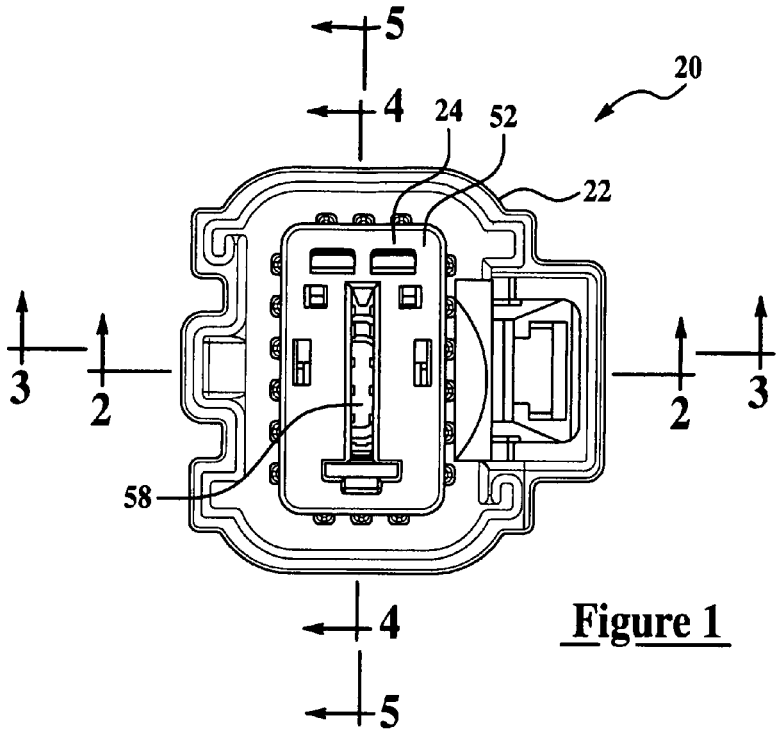
FIG. 1 is a front view of an electrical connector embodying the present invention.

Referring to the drawings and as best illustrated in FIGS. 1-6, an electrical connector 20 has an outer connector housing 22, an inner shuttle 24 and an electrically conductive terminal 26. The shuttle 24 generally first snap fits to the housing 22 in a rearward direction along a mating centerline 28. When snap fitted, the shuttle 24 is in a staged position 30 for receipt of the terminal 26 from an opposite direction along the centerline 28. The terminal 26 snap fits to the shuttle 24, and once snap fitted, the shuttle 24 is slid further into the housing 22 until the shuttle snap locks to the housing 22, thus rigidly orientating the terminal 26 for mating to another terminal or connector (not shown).

The housing 22 has a base portion 30 disposed substantially perpendicular to the centerline 28. A rear hole 32 in the base portion 30 for receipt of the terminal 26 is orientated co-axially with the centerline 28. A shroud 34 of the housing 22 projects forward from the base portion 30, generally circles the rear hole 32 and radially defines a connector cavity 36. A forward opening 38 (see FIGS. 2, 5 and 7) that receives the shuttle 24 is defined by a distal peripheral edge 40 of the shroud 34 so that the cavity 36 communicates between the forward opening 38 and the rear hole 32 along the centerline 28. Preferably, the hole 32, the cavity 36 and the forward opening 38 are substantially centered with respect to the centerline 28 and the opening 38 is larger than the hole 32 as dictated by the larger cross sectional area of the shuttle 24 with respect to the cross sectional area of the terminal 26, wherein the cross sections are taken generally perpendicular to the centerline. A circumferential skirt 42 of the housing 22 projects rearward from the base portion 30 and is substantially orientated concentrically to an insulated wire 44 crimped to the terminal 26. When the connector 20 is fully assembled, a sealing grommet or annular gasket 46 is press fitted or crimped radially between the skirt 42 and the insulated wire 44 to protect the electrical connection from dirt, debris and water.

The shuttle 24, which radially inwardly receives the terminal 26, has a staged position 48 (see FIGS. 2, 5 and 7) and a locked or assembled position 50 (see FIGS. 3 and 4) with respect to the housing 22. Preferably, the shuttle 24 is only maintained in the staged position 48 during assembly of the electrical connector 20 and otherwise remains in the locked position 50 during actual use of the electrical connector 20. Preferably, the shuttle has a forward flange 52 that spans radially outward further than the forward opening 38 of the housing 22. Projecting rearward from the forward flange 52 are a sliding member 54 and a cantilevered flex beam 56. Preferably, the sliding member 54 has a U-shaped cross section taken perpendicularly through the centerline 28 and thus extending circumferentially about the centerline to form in-part an alcove 58 for close receipt of the terminal 26.

Figure 6:
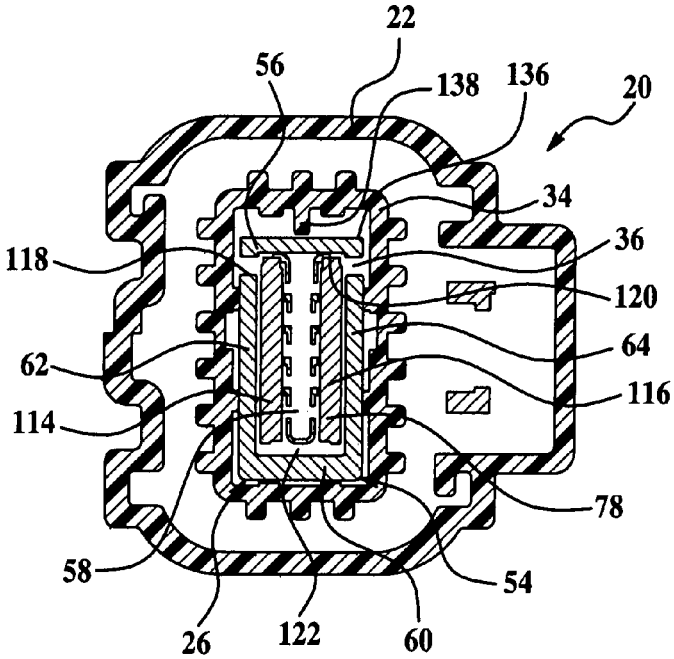
FIG. 6 is a cross section of the electrical connector taken along line 6-6 of FIG. 4.

As best illustrated in FIG. 6 and for ease of explanation but not limited in orientation as described and with respect to the U-shape cross section, the sliding member 54 has a substantially horizontal web segment 60 and two substantially vertical, parallel, and diametrically opposed partitions 62, 64 with the alcove 58 being defined between the wings 62, 64. The flex beam 56 extends slightly circumferentially about the centerline 28 and is circumferentially spaced from the axially extending tips of the partitions 62, 64. The alcove 58 is also defined in-part by the flex beam 56 that is generally diametrically opposed to the web segment 60. The partitions 62, 64 contribute toward rigidity of the web segment 60 and the circumferential spacing between the flex beam 56 and the partitions 62, 64 maintains flexibility of the flex beam 56 when the shuttle 24 is in the staged position 48 for lock engagement of the terminal 26.

The electrically conductive terminal 26 is similar to that disclosed in U.S. Pat. No. 6,416,340, which is incorporated herein by reference in its entirety. Prior to assembly of the connector 20, the terminal 26 is preferably pre-crimped to an electrical insulation 66 of an insulated wire 68 by crimp wings 70 of the terminal 26, and is preferably crimped to a stripped electrically conductive core 72 of the insulated wire 68 by crimp wings 74 orientated axially forward of crimp wings 70. The crimp wings 70, 74 are located axially between the grommet 46 and the base portion 30 of the housing 22 and radially inward of the housing skirt 42.

Figure 2:
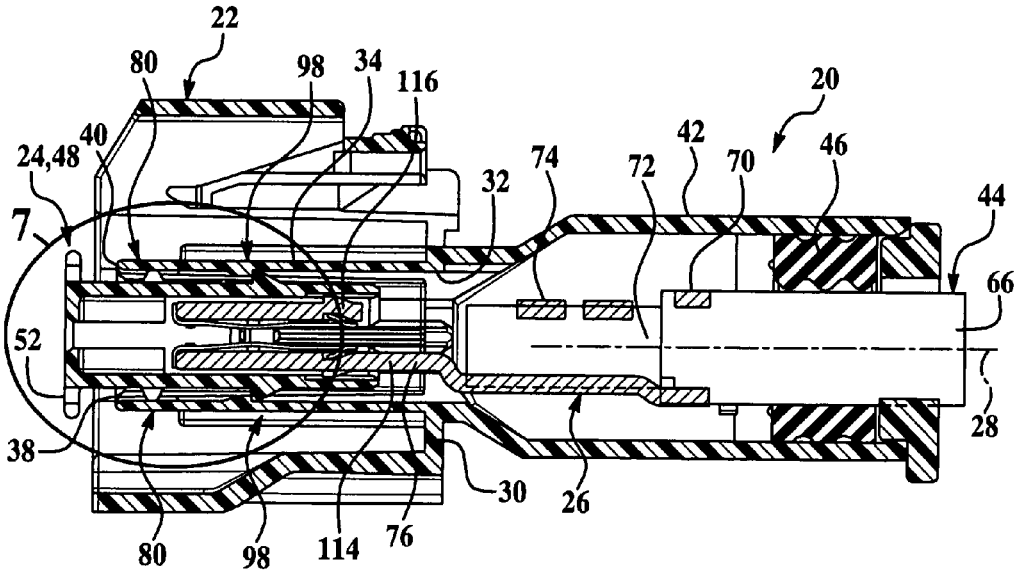
FIG. 2 is a cross section of the electrical connector illustrated in a staged position and taken along line 2-2 of FIG. 1.
Figure 3:
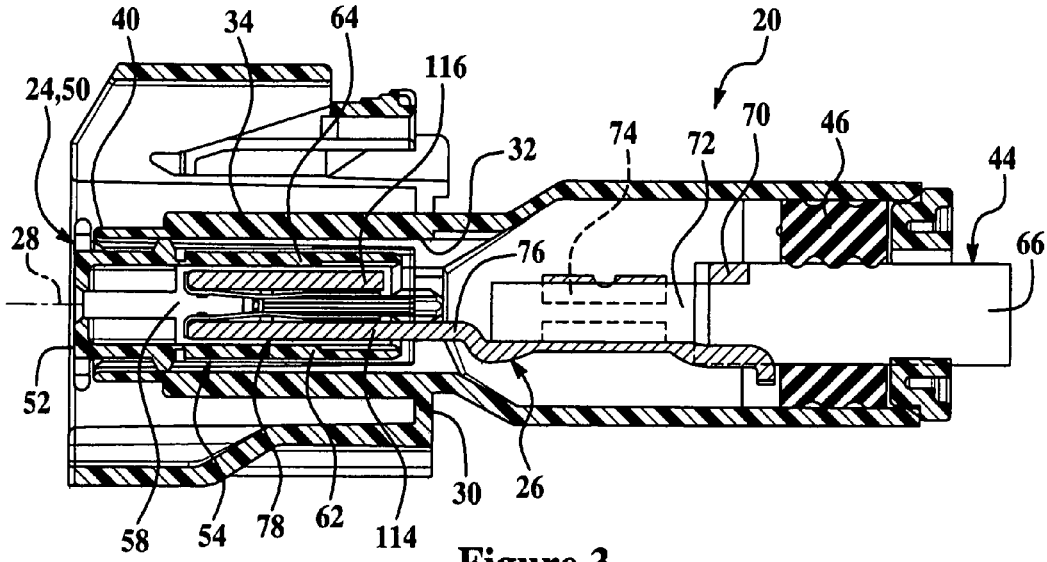
FIG. 3 is a cross section of the electrical connector illustrated in a assembled position and taken along line 3-3 of FIG. 1.

Referring to FIGS. 2 and 3, a neck 76 of the terminal projects axially forward from the crimp wings 74 and through the rear hole 32 in the housing base portion 30 to form into a mating portion 78 of the terminal 26. Preferably, the mating portion 78 is of a female-type having a U-shaped cross section when taken perpendicular to the centerline 28. The cross sectional area of the mating portion 78 is slightly less than the cross sectional area of the rear hole 32 allowing insertion of the mating portion 78 into the cavity 36 of the housing 22, and is smaller than the forward opening 38 so that the sliding member 54 and flex beam 56 of the shuttle 24 can be located radially between the terminal mating portion 78 and the housing shroud 34.

Figure 4:
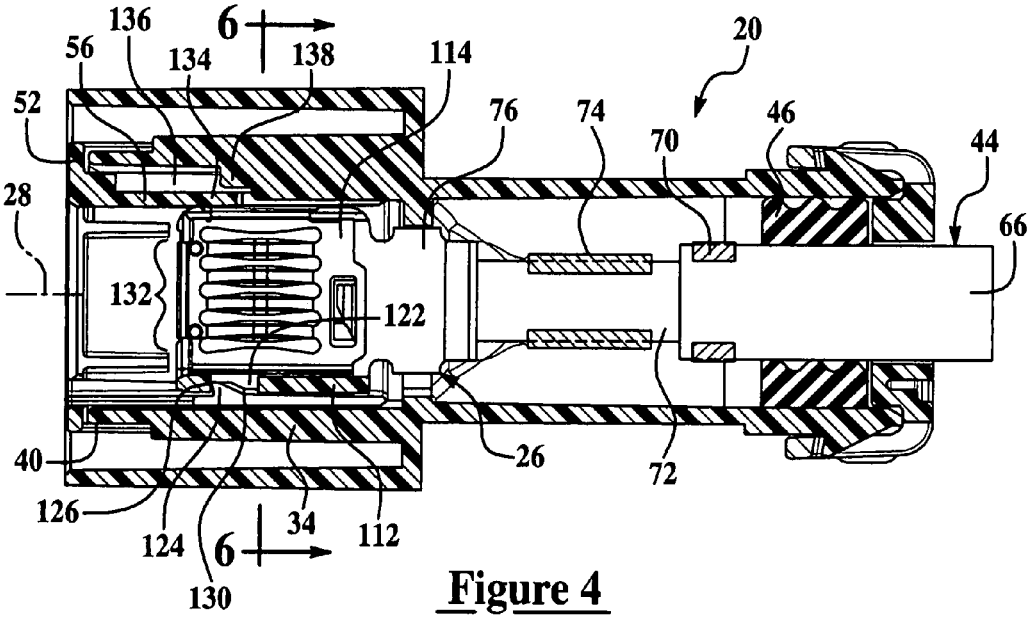
FIG. 4 is a cross section of the electrical connector illustrated in an assembled position and taken along line 4-4 of FIG. 1.
Figure 5:
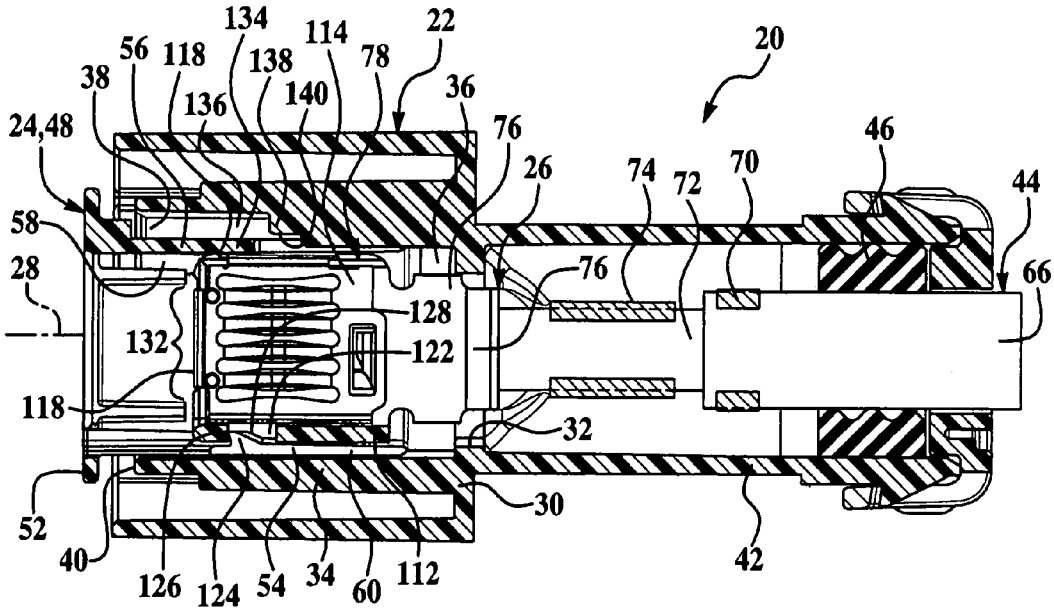
FIG. 5 is a cross section of the electrical connector illustrated in an staged position and taken along line 5-5 of FIG. 1.

Referring to FIGS. 4-6, the mating portion 78 of the terminal 26 has an axially elongated web portion 112 that is preferably spaced radially outward from and disposed substantially parallel to the centerline 28 and is located directly adjacent to the web segment 60 of the shuttle 24 for snap engaging thereto. The web portion 112 extends laterally between two substantially planar walls 114, 116 of the mating portion 78 that project from the web portion 112 to respective edges 118, 120 that lie within a common imaginary plane and extend axially and are preferably substantially parallel with the centerline 28. The first wall 114 is generally diametrically opposed to and spaced from the second wall 116 with respect to the centerline 28 for receipt of a male terminal (not shown) there between. The neck 76 of the terminal 26 co-extends with and connects unitarily to the first wall 114 so that the web portion 112 and second wall 116 is generally cantilevered from the first wall 114.

Figure 7:
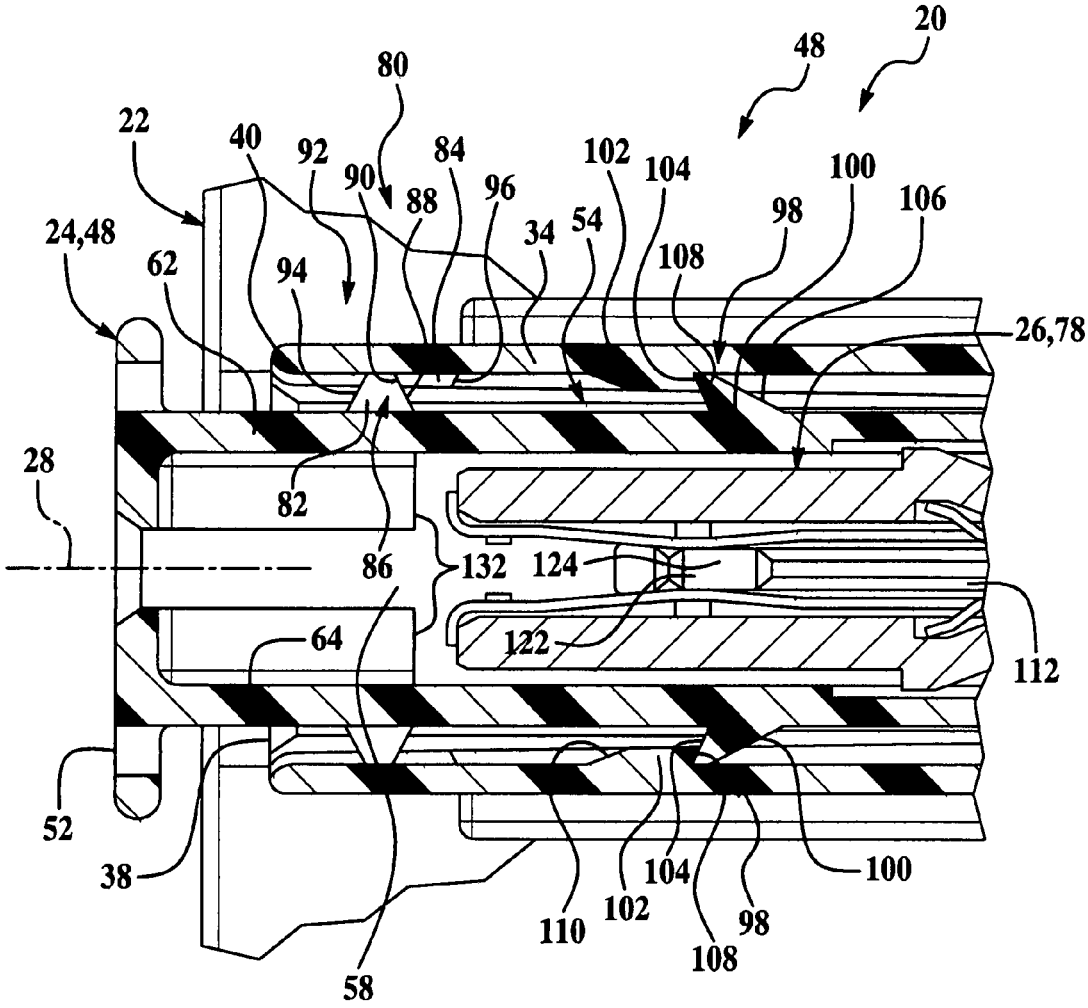
FIG. 7 is partial enlarged cross section of the electrical connector taken from the circle of FIG. 2.

Referring to FIGS. 2 and 7, preferably the connector 20 has two, two-way couplers 80 that are orientated substantially diametrically to one-another and carried between the housing shroud 34 and respective partitions 62, 64 of the shuttle 24 and in the cavity 36. The two-way coupler 80 yieldably resists axial shifting (i.e. rearward movement) of the shuttle 24 into the housing 22 when the shuttle is in the staged position 48 and preferably yieldably resists axial shifting of the shuttle 24 out of the housing 22 (i.e. forward movement) when the shuttle is in the fully assembled position 50. Each two-way coupler 80 preferably has a pair of interactive frustum-like tabs 82, 84. Tabs 82 of each pair project radially outward from respective partitions 62, 64, and tabs 84 project radially inward from the housing 22.

A snap-fit staging feature 86 of the two-way coupler 80 has a pair of rearward and forward facing stop faces 88, 90 carried by respective frustum-like tabs 82, 84. When the shuttle 24 is in the staged position 48, the rearward stop face 88 of tab 82 is in releasable and yieldable contact with the forward stop face 90 of tab 84 thus resisting further shuttle movement into the housing 22. When the shuttle 24 is in the assembled position 50 the rearward and forward stop faces 88, 90 do not confront one-another, but are generally opposed to or face away from one-another.

A snap-fit assembly retention feature 92 of the two-way coupler 80 has a pair of forward and rearward facing stop surfaces 94, 96 carried by respective frustum-like tabs 82, 84, but generally on opposite sides of the tabs to the respective rearward and forward stop faces 88, 90. When the shuttle 24 is in the fully assembled position 50, the forward stop surface 94 of tab 82 is in releasable and yieldable contact with the rearward stop surface 96 of tab 84 thus resisting withdrawal of the shuttle 24 from the housing 22. When the shuttle 24 is in the staged position 48 the forward and rearward stop surfaces 94, 96 do not confront one-another, but are generally opposed to or face axially away from one-another.

Preferably, the connector 20 has two one-way couplers 98 that are orientated diametrically to one-another and carried between the housing shroud 34 and respective partitions 62, 64 of the shuttle 24 and in the cavity 36. The one-way coupler 98 is non-yieldable and strongly resists withdrawal of the shuttle 24 from the housing 22 when the shuttle is in the staged position 48. This resistance against withdrawal permits snap-locking of the terminal 26 into the staged shuttle 24. Each one-way coupler 98 preferably has a pair of interactive prongs 100, 102. Prongs 100 of each pair project radially outward from respective partitions 62, 64 and slightly forward to a point, and prongs 102 project radially inward from the housing 22 and slightly rearward to a point.

Prong 100 carries a forward locking face 104 and a rearward ramp 106. The forward locking face is preferably orientated at an acute angle to the adjacent and respective partition 62, 64 of the shuttle 24. Prong 102 carries a rearward locking surface 108, which is preferably orientated at substantially the same acute angle to the adjacent shroud 34 of the housing 22, and a forward ramp 110. When the shuttle 24 is first being inserted into the housing shroud 34, the rearward ramp 106 of the shuttle prong 100 assists the prong 100 in traveling yieldably over the housing tab 84 and then yieldably over the prong 102 while sliding across the forward ramp 110 whereupon the prong 100 snaps radially outward when the shuttle reaches the staged position 38. When the shuttle 24 is in the staged position 48, the forward locking face 104 is in releasable contact with the rearward locking surface 108. Thus, when the shuttle 24 moves further into the housing away from the staged position 48 and toward the assembled position 50, the face 104 and surface 108 will remain facing each other and freely separate from one-another in an axial direction.

Referring to FIGS. 4, 5 and 7, the shuttle 24 has a ramped projection 124 that locks into a window 122 in the web portion 112 of the mating portion 78 of the terminal 26 when the shuttle 24 is in the staged position 48 and remains in this locked orientation as the shuttle is moved to the assembled position 50. The ramped projection 124 is similar in shape and orientation to the prongs 100, 102 of the shuttle except that the ramped projection 124 preferably projects radially into the alcove 58 from the more rigid web segment 60 of the sliding member 54 and not the slightly or more flexible partitions 62, 64. The projection 124 carries a forward stop 126 disposed substantially perpendicular to the centerline 28 and an opposite ramp 128 to ease terminal insertion. When the terminal 26 is locked to the shuttle 24, the projection 124 projects radially inward and into the window 122 so that the forward stop 126 contacts a rearward stop 130 carried by the terminal web portion 112 that generally defines the axially forward end of the window 122. Preventing over-insertion of the terminal 26 into the alcove 58 are rearward abutments 132 that generally project axially rearward from the flange 52 of the shuttle 24 to generally contact the leading first and second edges 116, 118 carried by the mating portion 78 of the of the terminal 26.

During assembly of the electrical connector 20, a leading distal end or edge of the sliding member 54 of the shuttle 24 is first inserted axially along the centerline 28 through the forward opening 38 of the shroud 34 of the connector housing 22. With continued insertion of the shuttle 24 into the cavity 36 in the shroud 34, the rearward ramp 106 of the prong 100 carried by the respective shuttle partitions 62, 64 slide upon the sloped forward stop surface 94 of the tab 84 carried by the shroud 34. To clear the tabs 84 during insertion of the shuttle 24, the partitions 62, 64 slightly flex resiliently and radially inward and snap radially outward once the prongs 100 are axially rearward of the tabs 84.

With continued insertion of the shuttle 24 toward the staged position 48, the rearward ramp 106 of the prong 100 slides upon the sloped forward ramp 110 of the prong 102 carried by the shroud 34. To clear the prongs 102, the partitions 62, 64 flex resiliently and radially inward and snap radially outward once the shuttle 24 is in the staged position 48. At this point, further insertion of the shuttle 24 into the cavity 36 is yieldably restricted by the staging feature 86 of the two-way coupler 80 wherein the rearward stop face 88 of the tab 82 contacts the forward stop face 90 of tab 84. Withdrawal of the shuttle 24 from the housing 22 is strongly resisted or prevented by the one-way coupler 98, wherein the forward locking face 104 of prong 100 contacts the rearward locking surface 108 of prong 102. Preferably, the common acute angle of face 104 and surface 108 will tend to pull the respective partitions 62, 64 tighter toward the shroud 34 should a withdrawal force be applied to the shuttle 24.

As best shown in FIG. 5, after the shuttle 24 has been moved axially rearward into the staged position 48, the mating portion 78 of the terminal 26 with the trailing pre-crimped wire 44 is moved axially forward through the skirt 42, through the rear hole 32, and into the cavity 36 then the alcove 58 of the shuttle 24. As the mating portion 78 of the terminal 26 approaches the ramp 128 of projection 124, the first and second edges 118, 120 of the respective terminal walls 114, 116 axially align to and are directly radially inward from a distal catch end 134 of the flex beam 56 of the shuttle 24. Consequently, as the rigid terminal web portion 112 rides upward upon the ramp 128 of the projection 124, the edges 118, 120 slide along the flex beam 56 and flex the beam 56 radially outward and into an elongated clearance 136. The clearance is generally defined radially or laterally between the shroud 34 and the flex beam 56 and is generally defined axially or longitudinally between the shuttle flange 52 and a rearward reinforcement structure 138 of the shroud 34.

When the projection 128 is axially aligned to the window 122, the resilient radially inward force of the flex beam 56 causes the terminal web portion 112 to move radially outward placing the shuttle projection 124 in the window 122. Any further movement of the terminal 26 into the alcove 58 is prevented by contact of the abutments 132 with the terminal mating portion 78.

When axially moving the shuttle 24 rearward from the staged position 48 and toward the assembled position 50, the abutments 132 maintain axial alignment of the terminal 26 with the shuttle 24. During movement toward the assembled position 50, the prong 100 spaces axially rearward from the prong 102 of the one-way coupler 98 and the distal catch end 134 of the flex beam 56 aligns snuggly between a radially inward facing surface 140 (see FIG. 5) of the reinforcement structure 138 and the first and second edges 118, 120 of the respective terminal walls 114, 116. Substantially simultaneously, the rearward stop face 88 of the shuttle tab 82 of the two-way coupler 80 rides over the forward stop face 90 of the housing tab 84, thus flexing the respective shuttle partitions 62, 64 resiliently radially inward. Although the reinforcement structure 138 is illustrated (see FIG. 6) as a forward extending and radially inward projecting rib, it can take any variety of forms that achieve the snug fit of the distal catch end 134.

Referring to FIGS. 3 and 4, when the shuttle 24 has reached the assembled position 50, the shuttle tab 82 has passed over the housing tab 84 of the two-way coupler 80 and the partitions 62, 64 flex back to their natural state placing the forward stop surface 94 of shuttle tab 82 in close contact with the rearward stop surface 96 of the housing tab 84. The distal catch end 134 of the flex beam 56 is snugly fitted radially between the reinforcement structure 138 and the terminal walls 114, 116 thus preventing rocking or other movement of the terminal 26 with respect to the shuttle 24 and housing 22. Moreover, the shuttle flange 52 is in close axial proximity to the peripheral edge 40 of the shroud 34 preventing any entry of debris between the shuttle and housing.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention.

The invention claimed is:

1. An electrical connector comprising:

a housing;

a shuttle having a staged position wherein the shuttle is partially inserted into the housing from a first direction and an assembled position wherein the shuttle is fully inserted into the housing; and an electrically conductive terminal constructed and arranged to snap lock to the shuttle when the shuttle is in the staged position, wherein the shuttle has a sliding member projecting into the housing along the first direction, wherein the sliding member has a web segment, wherein the shuttle has a projection projecting inwardly from the web segment; and wherein the projection snap fits into a window in the terminal when the shuttle moves to the staged position and remains in the window as the shuttle moves to the assembled position.

2. The electrical connector as set forth in claim 1 wherein the shuttle has a flex beam that is spaced inward from the housing when the shuttle is in the staged position and disposed snuggly between the housing and the terminal when the shuttle is in the assembled position.

3. The electrical connector as set forth in claim 2 wherein the sliding member has a partition that provides rigidity to the web segment.

4. The electrical connector set forth in claim 3 further comprising a staging feature carried between the shuttle and the housing for yieldably resisting shuttle movement from the staged position to the assembled position, a one-way coupler carried between the shuttle and the housing for preventing withdrawal of the shuttle from the housing when the shuttle is in the staged position and during insertion of the terminal into the shuttle, and an assembly retention feature carried between the shuttle and the housing for snap fitting the shuttle to the housing when in the assembled position, and wherein the staging feature, the assembly retention feature and the one-way coupler are carried in-part by the partition.

5. The electrical connector set forth in claim 4 wherein the assembly retention feature and the staging feature provide two-way retention of the shuttle within the housing.

6. The electrical connector set forth in claim 2 wherein the terminal is inserted into the shuttle from a second direction that is opposite the first direction.

7. The electrical connector set forth in claim 6 further comprising a staging feature carried between the shuttle and the housing for yieldably resisting shuttle movement from the staged position to the assembled position.

8. The electrical connector set forth in claim 7 further comprising a one-way coupler carried between the shuttle and the housing for preventing withdrawal of the shuttle from the housing when the shuttle is in the staged position and during insertion of the terminal into the shuttle.

9. The electrical connector set forth in claim 8 further comprising an assembly retention feature carried between the shuttle and the housing for snap fitting the shuttle to the housing when in the assembled position.

10. The electrical connector set forth in claim 9 wherein the assembly retention feature and the staging feature provide two-way retention of the shuttle within the housing.

11. The electrical connector set forth in claim 10 further comprising the shuttle having a sliding member projecting into the housing along the first direction and the sliding member having a web segment and a partition that provides rigidity to the web segment, and wherein the staging feature, the assembly retention feature and the one-way coupler are carried in-part by the partition.

12. An electrical connector comprising:

a housing;

a shuttle having a staged position wherein the shuttle is partially inserted into the housing from a first direction and an assembled position wherein the shuttle is fully inserted into the housing; and an electrically conductive terminal constructed and arranged to snap lock to the shuttle when in the staged position, wherein the terminal is inserted into the shuttle from a second direction that is opposite the first direction, wherein a flex beam of the shuttle is spaced inward from the housing when the shuttle is in the staged position and disposed snuggly between the housing and the terminal when the shuttle is in the assembled position, wherein a staging feature is carried between the shuttle and the housing for yieldably resisting shuttle movement from the staged position to the assembled position, wherein a one-way coupler is carried between the shuttle and the housing for preventing withdrawal of the shuttle from the housing when the shuttle is in the staged position and during insertion of the terminal into the shuttle, wherein an assembly feature is carried between the shuttle and the housing for snap filling the shuttle to the housing when in the assembled position, wherein the assembly retention feature and the staging feature provide two-way coupling of the shuttle within the housing, wherein the shuttle has a projection projecting inwardly from a web segment that snap fits into a window of the terminal when the shuttle moves to the staged position and remains in the window as the shuttle moves to the assembled position, and wherein the terminal contacts and resiliently flexes a flex beam of the shuttle outward as the terminal rides over the projection for snap locking into the window.

13. An electrical connector comprising:

a centerline;

a housing having a forward opening and a rearward hole orientated along the centerline;

an electrically conductive terminal having a maximum cross sectional area disposed perpendicular to the centerline and being less than an area of the forward opening and an area of the rearward hole;

a shuttle projecting axially through the forward opening and located radially between the terminal and the housing; and wherein the terminal is snap locked to the shuttle and the shuttle is snap locked to the housing, the shuttle having a staged position, an assembled position orientated rearward of the staged position, and a one-way coupler carried between the shuttle and the housing for preventing forward movement of the shuttle with respect to the housing when in the staged position and when the terminal is being inserted into the shuttle in a forward direction through the rearward hole and wherein the one-way coupler has a first ramped prong projecting radially outward from a the shuttle and a second ramped prong projecting radially inward from the housing for axial contact with the first prong and with respect to the centerline when the shuttle is in the staged position and the terminal is being inserted into the shuttle in the forward direction.

14. An electrical connector comprising:

a centerline;

a housing having a forward opening and a rearward hole orientated along the centerline;

an electrically conductive terminal having a maximum cross sectional area disposed perpendicular to the centerline and being less than an area of the forward opening and an area of the rearward hole;

a shuttle projecting axially through the forward opening and located radially between the terminal and the housing;

wherein the area of the rearward hole is less than the area of the forward opening;

further comprising the shuttle having a flex beam projecting rearward and disposed radially between a reinforcement structure of the housing and the terminal;

further comprising the shuttle having a staged position, an assembled position orientated rearward of the staged position, and a one-way coupler carried between the shuttle and the housing for preventing forward movement of the shuttle with respect to the housing when in the staged position and when the terminal is being inserted into the shuttle in a forward direction through the rearward hole, wherein the terminal is snap locked to the shuttle and the shuttle is snap locked to the housing, and wherein the one-way coupler has a first ramped prong projecting radially outward from a the shuttle and a second ramped prong projecting radially inward from the housing for axial contact with the first prong and with respect to the centerline when the shuttle is in the staged position and the terminal in being inserted into the shuttle in the forward direction.

15. The electrical connector set forth in claim 14 wherein the first prong projects from a resiliently flexible partition of the shuttle.

16. The electrical connector set forth in claim 15 wherein the first prong is spaced axially rearward of the second prong when the shuttle is in the assembled position.

17. An electrical connector comprising:

a centerline;

a housing having a forward opening and a rearward hole orientated along the centerline;

an electrically conductive terminal having a maximum cross sectional area disposed perpendicular to the centerline and being less than an area of the forward opening and an area of the rearward hole;

a shuttle projecting axially through the forward opening and located radially between the terminal and the housing;

wherein the terminal is snap locked to the shuttle and the shuttle is snap locked to the housing;

wherein the area of the rearward hole is less than the area of the forward opening;

wherein the shuttle has a flex beam projecting rearward and disposed radially between a reinforcement structure of the housing and the terminal, and wherein the flex beam is free to flex radially outward into a clearance defined between radially between the shuttle and the housing and axially forward of the reinforcement structure when the shuttle is in the staged position and wherein the flex beam is in contact with a surface of the reinforcement member that faces radially inward when the shuttle is in the assembled position.

18. An electrical connector comprising:

a centerline;

a housing having a forward opening and a rearward hole orientated along the centerline;

an electrically conductive terminal having a maximum cross sectional area disposed perpendicular to the centerline and being less than an area of the forward opening and an area of the rearward hole;

a shuttle projecting axially through the forward opening and located radially between the terminal and the housing;

wherein the terminal is snap locked to the shuttle and the shuttle is snap locked to the housing;

wherein the area of the rearward hole is less than the area of the forward opening;

wherein the shuttle has a flex beam projecting rearward and disposed radially between a reinforcement structure of the housing and the terminal, and wherein the flex beam is free to flex radially outward into a clearance defined between radially between the shuttle and the housing and axially forward of the reinforcement structure when the shuttle is in the staged position and wherein the flex beam is in contact with a surface of the reinforcement member that faces radially inward when the shuttle is in the assembled position, and wherein the shuttle has a sliding member projecting into the housing along the first direction, wherein the sliding member has a web segment, wherein the shuttle has a projection projecting inwardly from web segment; and wherein the projection snap fits into a window in the terminal when the shuttle moves to the staged position and remains in the window as the shuttle moves to the assembled position.

* * * * *